US009106009B2

(12) United States Patent
Zhao et al.

(10) Patent No.: US 9,106,009 B2
(45) Date of Patent: Aug. 11, 2015

(54) ELECTRICAL CONTACT AND ELECTRICAL CONNECTOR ASSEMBLY INCLUDING THE SAME

(71) Applicants: Tyco Electronics Corporation, Berwyn, PA (US); Tyco Electronics (Shanghai) Co., Ltd., Shanghai (CN)

(72) Inventors: YuQiang Zhao, Shanghai (CN); Robert Paul Nichols, Vacaville, CA (US); Guangming Zhao, Shanghai (CN); Michael Allen Blanchfield, Camp Hill, PA (US)

(73) Assignees: TYCO ELECTRONICS (SHANGHAI) CO., LTD., Shanghai (CN); TYCO ELECTRONICS CORPORATION, Berwyn, PA (US)

( * ) Notice: Subject to any disclaimer, the term of this patent is extended or adjusted under 35 U.S.C. 154(b) by 41 days.

(21) Appl. No.: 13/922,671

(22) Filed: Jun. 20, 2013

(65) Prior Publication Data

US 2014/0302723 A1 Oct. 9, 2014

(51) Int. Cl.
*H01R 12/00* (2006.01)
*H01R 12/58* (2011.01)

(52) U.S. Cl.
CPC ..... *H01R 12/585* (2013.01)

(58) Field of Classification Search
CPC ..... H01R 12/585; H05K 3/308
USPC ..... 439/82, 751
See application file for complete search history.

(56) References Cited

U.S. PATENT DOCUMENTS

| | | | | |
|---|---|---|---|---|
| 4,857,018 | A * | 8/1989 | Pickles | 439/751 |
| 5,106,310 | A * | 4/1992 | Krajewski et al. | 439/75 |
| 5,106,328 | A * | 4/1992 | Prochaska et al. | 439/751 |
| 6,428,329 | B2 * | 8/2002 | Orui et al. | 439/75 |
| 6,565,392 | B2 | 5/2003 | Padro | |
| 6,890,214 | B2 | 5/2005 | Brown et al. | |
| 7,065,871 | B2 | 6/2006 | Minich et al. | |
| 7,186,121 | B1 | 3/2007 | Costello et al. | |
| 7,527,533 | B2 | 5/2009 | Lappoehn | |
| 7,780,483 | B1 | 8/2010 | Ravlich | |
| 7,997,938 | B2 | 8/2011 | Costello et al. | |
| 8,002,559 | B2 | 8/2011 | Thiel et al. | |

OTHER PUBLICATIONS 1469921-1 MiniPak HD Power-Signal Connector (Sep. 2008).
EXTreme Ten60Power Hybrid Power and Signal Connectors (2011).
Minipak High-Density Board-to-Board Power Connectors, Tyco Electronics (2010).
Molex Extreme Power Products Catalog (downloaded Feb. 6, 2013).
Molex Power Connectors Catalog (partial) (downloaded Feb. 6, 2013).

(Continued)

*Primary Examiner* — Phuong Dinh

(57) ABSTRACT

Electrical contact having a body portion and a compliant contact tail that is coupled to the body portion and configured to be inserted into a plated thru-hole (PTH). The contact tail extends from the body portion along a central axis to a leading end. The contact tail includes first and second compliant regions that are located between the leading end and the body portion. The contact tail has a joint region that joins the first and second compliant regions. Each of the first and second compliant regions is dimensioned to mechanically engage the PTH when inserted therein. The joint region is dimensioned smaller than the first and second compliant regions such that the joint region moves freely through the PTH.

8 Claims, 5 Drawing Sheets

(56) References Cited

OTHER PUBLICATIONS

Multi-Beam XL and Multi-Beam XLE Power Distribution Connector Systems (2010).
Multi-Beam XL Connectors (Apr. 6, 2011).
Product Specification for Ten60Power Board to Board Interconnect Systems (Aug. 2011).
SD-46436-1080 Molex Ten60 Power Receptacle (Jul. 2009).
SD-46562-1171 Molex Ten60 Vertical Receptacle (Nov. 2010).
Solutions for AdvancedTCA, AdvancedTCA 300, MicroTCA, and AdvancedMC Standards, Tyco Electronics (2007).

* cited by examiner

ELECTRICAL CONTACT AND ELECTRICAL CONNECTOR ASSEMBLY INCLUDING THE SAME

CROSS-REFERENCE TO RELATED APPLICATION

The present application claims the benefit of Chinese Patent Application No. 201310118867.2, filed on Apr. 8, 2013, which is incorporated herein by reference in its entirety.

BACKGROUND

The subject matter herein relates generally to an electrical contact that is configured to be inserted into a plated thru-hole (PTH) and an electrical connector assembly that includes such electrical contacts.

Solderless press-fit electrical contacts are commonly used for mounting an electrical connector assembly to a circuit board in telecommunication equipment or other electronic devices. One example of such an electrical contact includes a compliant contact tail that is shaped to form a pair of beams that join each other at their respective ends with a contact void between the beams. Some of these electrical contacts may be characterized as eye-of-needle (EON) electrical contacts. The beams are configured to engage an interior wall of a corresponding PTH in the circuit board during a mounting operation. The configuration of the beams and the contact void allow the beams to be deflected radially inward by the interior wall as the contact tail is inserted into the PTH. Outer surfaces of the beams form a frictional engagement (e.g., interference fit) with the PTH. As such, an electrical connection between the electrical contact and the PTH may be established without the use of solder and with a reduced likelihood of damage occurring to the PTH and/or PCB, which may occur when using rigid electrical contacts.

Known electrical contacts and the corresponding electrical connector assemblies that include such contacts are typically designed for a particular device or certain equipment. For example, the contact tails of the electrical contacts may project from the mounting surface of an electrical connector assembly that is coupled to a circuit board. The contact tails are configured so that the beams engage a PTH of the circuit board at a certain distance from the mounting surface. While the electrical contacts may operate suitably with the electrical connector assembly, at some point during the lifetime of the device, it may be desirable to replace or modify certain parts within the device. The changes to the device, however, may effectively change the spatial relationship of the electrical connector assembly with respect to the circuit board. For example, the circuit board may be positioned further away from the mounting surface after the device is modified. Thus, a different electrical connector assembly may be required.

Accordingly, there is a need for an electrical connector assembly that is capable of engaging a circuit board at different spatial positions with respect to the mounting surface of the electrical connector assembly.

BRIEF DESCRIPTION

In one embodiment, an electrical contact is provided that includes a body portion and a compliant contact tail that is coupled to the body portion and configured to be inserted into a plated thru-hole (PTH). The contact tail extends from the body portion along a central axis to a leading end. The contact tail includes first and second compliant regions that are located between the leading end and the body portion. The contact tail has a joint region that joins the first and second compliant regions. Each of the first and second compliant regions is dimensioned to mechanically engage the PTH when inserted therein. The joint region is dimensioned smaller than the first and second compliant regions such that the joint region moves freely through the PTH.

Each of the first and second compliant regions and the joint region may have a maximum cross-sectional dimension that is measured transverse to the central axis. The maximum cross-sectional dimension of the joint region may be less than either of the maximum cross-sectional dimensions of the first and second compliant regions.

In some embodiments, at least one of the first and second compliant regions may include a plurality of flex beams that are connected to the joint region. The flex beams are bowed away from the central axis, wherein the flex beams engage the PTH and are deflected toward the central axis when the contact tail is inserted into the PTH.

The contact tail may have a plurality of stamped edges. In some embodiments, the stamped edges may extend along a common body plane. As one example, each of the first and second compliant regions may have an eye-of-needle (EON) configuration. In alternative embodiments, the stamped edges do not continuously extend within a common plane.

The contact tail may be configured such that a common insertion operation in which the contact tail moves in a single direction into the PTH is capable of positioning at least one of the first and second compliant regions within the PTH.

In another embodiment, an electrical connector assembly is provided that includes a connector housing having a mating face configured to engage a mating connector and a mounting face configured to be mounted onto a circuit board having an array of plated thru-holes (PTHs). The connector assembly also includes a plurality of electrical contacts having contact tails that project from the mounting surface. The contact tails extend along respective central axes to respective leading ends. Each of the contact tails of the plurality of electrical contacts is configured to be inserted into a corresponding PTH. Each of the contact tails of the plurality of electrical contacts includes first and second compliant regions that are located between the leading end and the mounting surface. Each of the contact tails of the plurality of electrical contacts includes a joint region that joins the first and second compliant regions. Each of the first and second compliant regions is dimensioned to mechanically engage the PTH when inserted therein. The joint region is dimensioned smaller than the first and second compliant regions such that the joint region moves freely through the PTH.

In some embodiments, the connector assembly also includes a discrete layer that has a plurality of passages. Each of the passages is configured to receive one of the contact tails. The discrete layer is configured to surround exposed portions of the contact tails. Optionally, the discrete layer is configured to surround the leading ends of the contact tails or the compliant region that is located closest to the mounting surface.

Optionally, the connector assembly may include a second plurality of electrical contacts that project from the mounting surface. The electrical contacts from the second plurality may be identical to the electrical contacts of the first plurality or can be different. For example, the electrical contacts from the second plurality may have only a single compliant region.

DETAILED DESCRIPTION

Figure 1:
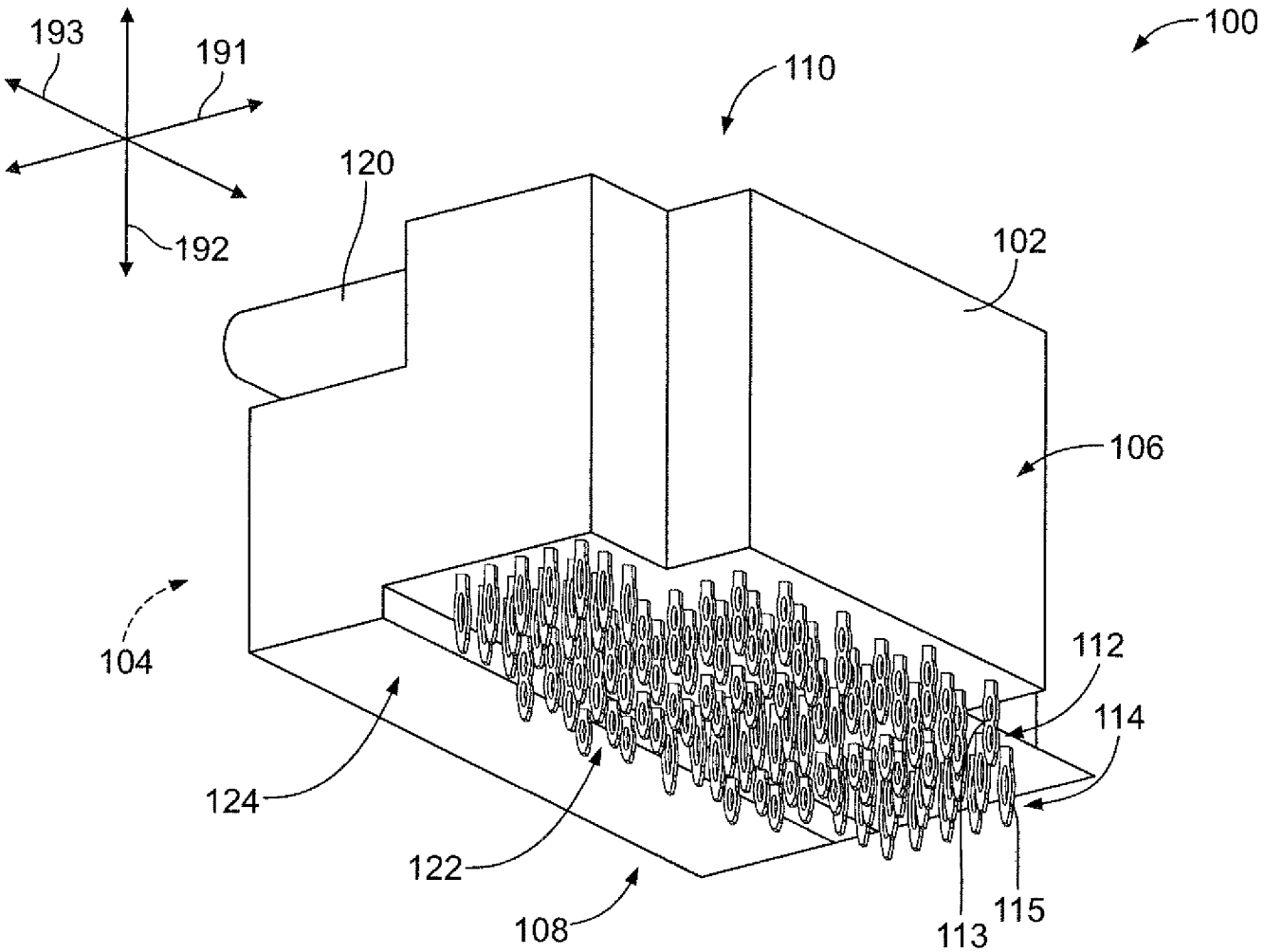
FIG. 1 is a bottom perspective view of an electrical connector assembly having a plurality of electrical contacts formed in accordance with one embodiment.

Embodiments described herein include electrical contacts, which may also be referred to as compliant or press-fit contacts, and electrical connector assemblies that include such electrical contacts. Embodiments may also include circuit board assemblies or electrical systems including the same. The electrical contacts may include multi-compliant contact tails that are configured to engage plated thru-holes (PTHs) of a circuit board. As used herein, a PTH may extend completely through a circuit board or only partially through a circuit board. The electrical contacts may have a first compliant region that has a first axial location along the contact tail, and a second compliant region that has a different second axial location along the contact tail. The first and second compliant regions may be separated by and joined by a joint region. Each of the first and second compliant regions may be configured to engage the same PTH. For example, when the contact tail is operably positioned within the PTH, each of the compliant regions may be engaged to the PTH or, alternatively, only one of the compliant regions may be engaged to the PTH while the other compliant region is not located within the PTH and/or not engaged to the PTH.

In some embodiments, each of the first and second compliant regions may include a wall-engaging structure (e.g., a plurality of flex beams, a plurality of contoured walls, C-shaped region, etc.) that has outwardly-facing surfaces (or mating surfaces) configured to engage the PTH. The wall-engaging structure may define a contact void, which may permit the wall-engaging structure to be compressed radially inward and thereby reduce a size of the contact void. When the wall-engaging structure is located in the PTH, the outwardly-facing surfaces of the wall-engaging structure mechanically and electrically engage an interior wall of the PTH.

In particular embodiments, the first and second compliant regions are mechanically separated by the joint region such that, during an insertion operation, compression of one compliant region does not cause compression of the other compliant region. In some embodiments, the first and second compliant regions of the electrical contacts may mechanically operate in similar manners such that the compliant regions are compressed by the PTH in similar manners. For instance, each of the first and second compliant regions may have an eye-of-needle (EON) configuration in which flex beams of the compliant regions are deflected toward each other.

Multi-compliant contact tails may enable a single connector assembly to engage circuit boards that have different spatial positions with respect to the connector assembly. During a mounting operation (or insertion operation), a manufacturer may position the first compliant region in the PTH or the second compliant region in the PTH using only one mounting action or motion. In other words, the mounting operation may require only a single contact-engaging step. In some embodiments, a discrete layer may be used to cover exposed portions of the electrical contacts. For instance, the discrete layer may be positioned between the connector assembly and the circuit board or, alternatively, the circuit board may be positioned between the connector assembly and the discrete layer.

FIG. 1 is a bottom perspective view of an electrical connector assembly 100 formed in accordance with one embodiment. The connector assembly 100 is oriented with respect to axes 191-193, including a mating axis 191, a mounting axis 192, and a lateral axis 193. The connector assembly 100 has a connector housing 102 that includes a mating face 104 and a back side 106 that face in opposite directions along the mating axis 191. The connector assembly 100 also has a mounting face or side 108 and a top side 110 that face in opposite directions along the mounting axis 192. In the illustrated embodiment, the connector assembly 100 is configured to engage a mating connector (not shown) at the mating face 104 and be mounted to another electrical component, such as the circuit board 300 (shown in FIG. 5), at the mounting face 108.

The connector assembly 100 may include an alignment feature 120 that engages one or more surfaces of the mating connector to align the connectors during a mating operation. In the illustrated embodiment, the alignment feature 120 is an elongated post having a dome-shaped end. However, various alternative types of alignment features may be used with the connector assembly 100.

To establish a communicative coupling between the mating connector and the circuit board 300, the mounting face 108 includes a plurality of electrical contacts 112 and a plurality of electrical contacts 114 that are configured to be inserted into corresponding PTHs 200 (shown in FIG. 4) of the circuit board 300. The electrical contacts 112, 114 include respective contact tails 113, 115. Although not shown, the mating face 104 may also include contact tails of the electrical contacts 112, 114 or different electrical contacts that are electrically coupled to the electrical contacts 112, 114. For example, the contact tails along the mating face 104 may be disposed within a mating cavity (not shown) that receives the mating connector. The contact tails along the mating face 104 may be similar to the contact tails 113 or 115 or the contact tails may be different. For example, the contact tails may be sockets or receptacles configured to receive a pin contact.

The electrical contacts 112, 114 may be characterized as compliant contacts or press-fit contacts that form an interference fit with the corresponding PTH 200. The contact tails 113, 115 are configured to be inserted into the corresponding PTH 200. The contact tails 113, 115 are sized and shaped to be slightly larger than the corresponding PTHs 200. The contact tails 113, 115 may then flex and/or be deformed to accommodate the smaller size of the PTH 200. The flexibility or deformability of the contact tails 113, 115 decreases the likelihood of damage to the PTHs 200. Nonetheless, the contact tails 113, 115 may form a frictional engagement (e.g., interference fit) with the corresponding PTH 200 that maintains the electrical connection and reduces the likelihood of inadvertent removal.

The electrical contacts 112 may be multi-compliant contacts. As described herein, the contact tails 113 may be configured to mechanically and electrically engage circuit boards at different axial locations along the contact tails 113. Thus, the circuit boards can have different spatial positions with respect to the connector assembly 100. The electrical contacts 114 may be configured differently (e.g., different size and/or shape) than the electrical contacts 112. In the illustrated embodiment, the electrical contacts 114 are EON-type contacts.

As shown, the mounting face 108 includes a loading area 122 and a front-end area 124 that are offset with respect to each other along the mounting axis 192. In the illustrated embodiment, the loading area 122 is configured to interface with the circuit board 300 (FIG. 5) and includes the electrical contacts 112, 114. The front-end area 124 is not configured to interface with the circuit board 300 and, instead, may clear a front-edge of the circuit board 300. In alternative embodiments, the front-end area 124 may also include electrical contacts. In other embodiments, the loading area 122 and the front-end area 124 are not offset with respect to each other but, instead, may coincide with a common body plane.

In the illustrated embodiment, the connector assembly 100 is a power-signal connector, similar to the connectors in the Multi-Beam XL™ product line by TE Connectivity. As another example, the connector assembly 100 may be a high-speed backplane connector, similar to the STRADA Whisper® product line developed by TE Connectivity. However, other embodiments may have different capabilities. Moreover, embodiments are not limited to the structural configuration shown in FIG. 1. For example, the connector assembly 100 is a right-angle connector in which the mating connector faces in a direction that is parallel to a surface of the circuit board 300 and along the mating axis 191. Alternative embodiments may include vertical connectors in which the electrical connector faces in a direction that is orthogonal (e.g., perpendicular) to the surface of the circuit board 300 and along the mounting axis 192. Another alternative embodiment may include a board-to-board bridge connector in which a portion of the mounting face engages one circuit board and a different portion of the mounting face engages another circuit board. Accordingly, embodiments are not intended to be limited to the particular types of connector assemblies shown and described herein.

Figure 3:
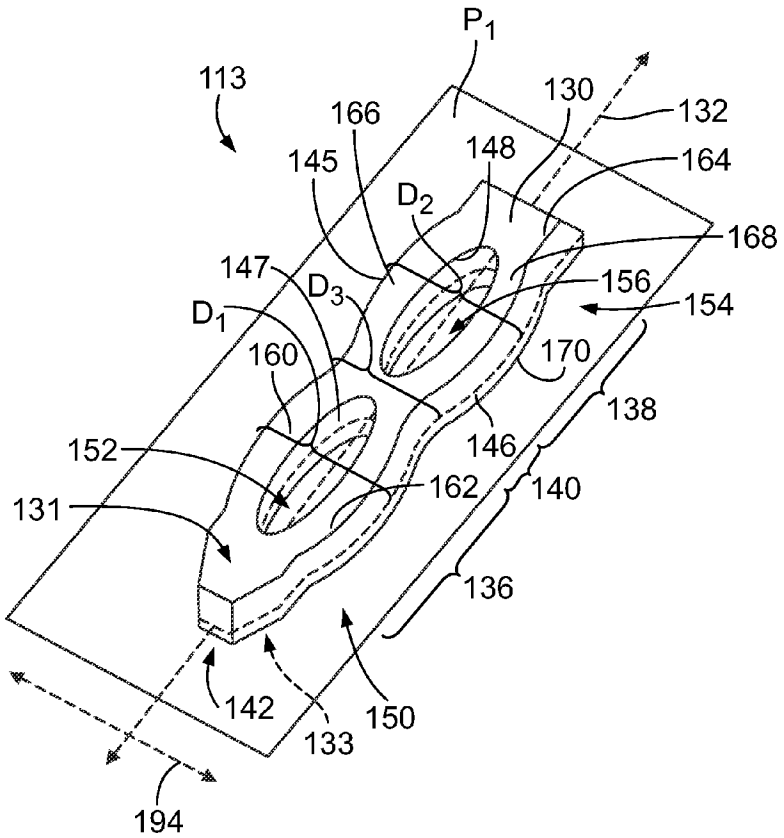
FIG. 3 is a perspective view of the contact tail of the electrical contact in accordance with one embodiment.
Figure 2:
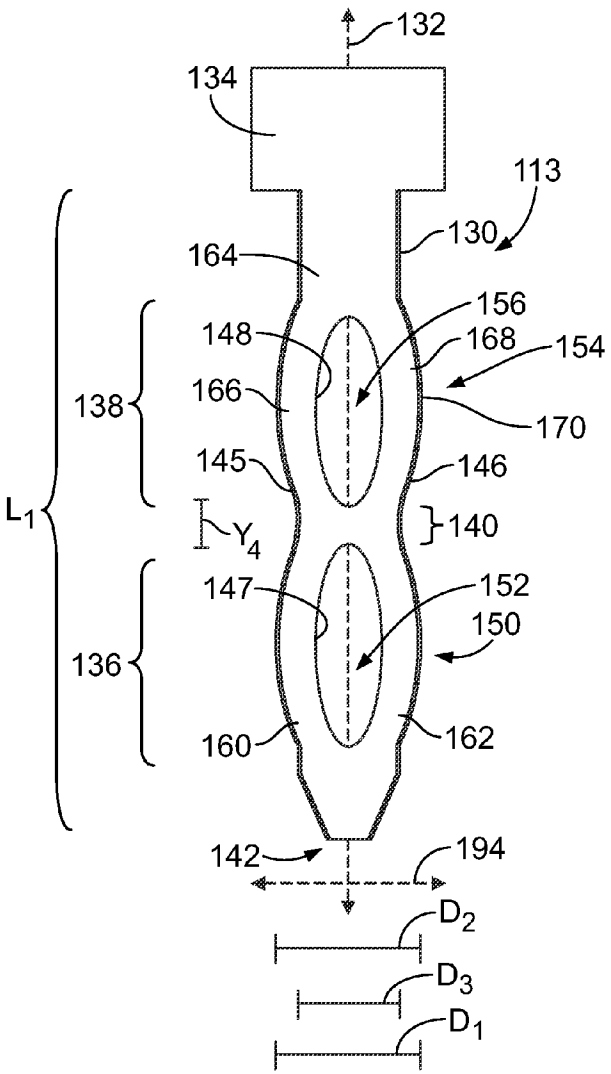
FIG. 2 is a side view of a portion of one of the electrical contacts in FIG. 1 illustrating a compliant contact tail of the electrical contact.
Figure 5:
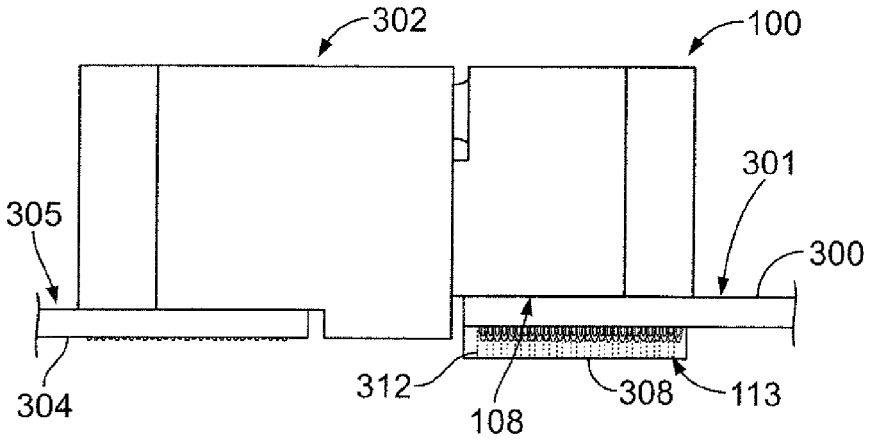
FIG. 5 is a side view of the electrical connector assembly of FIG. 1 mounted to a circuit board that has a first spatial position with respect to the electrical connector assembly.

FIGS. 2 and 3 illustrate a side view and a perspective view, respectively, of one of the contact tails 113 in accordance with one embodiment. The contact tail 113 has an elongated contact body 130 that is oriented with respect to a central axis 132 that extends through a center of the contact body 130. As shown in FIG. 2, the contact tail 113 has a length $L_1$ that is measured along the central axis 132. The central axis 132 may extend parallel to the mounting axis 192 (FIG. 1) when the connector assembly 100 (FIG. 1) is mounted to the circuit board 300 (FIG. 5).

The electrical contacts 112 (FIG. 1) and/or the contact tails 113 may be stamped and, optionally, formed from conductive sheet material (e.g., copper alloy material). In particular embodiments, the electrical contacts 112 and/or the contact tails 113 are stamped from the sheet material and then formed by shaping the electrical contact or contact tail. The electrical contacts 112 and/or the contact tails 113 may or may not have a uniform thickness. Although not shown, the contact body 130 or one or more portions of the contact body 130 may include a coating thereon.

With respect to FIG. 2, the contact body 130 extends from a body portion 134 to a leading end or tip 142 along the central axis 132. Although not shown, the body portion 134 may be part of the electrical contact 112 and may extend to a mating end that is configured to engage another contact. The body portion 134 may be similar to one of the body portions 333, 336, or 348 shown in FIG. 7.

Figure 4:
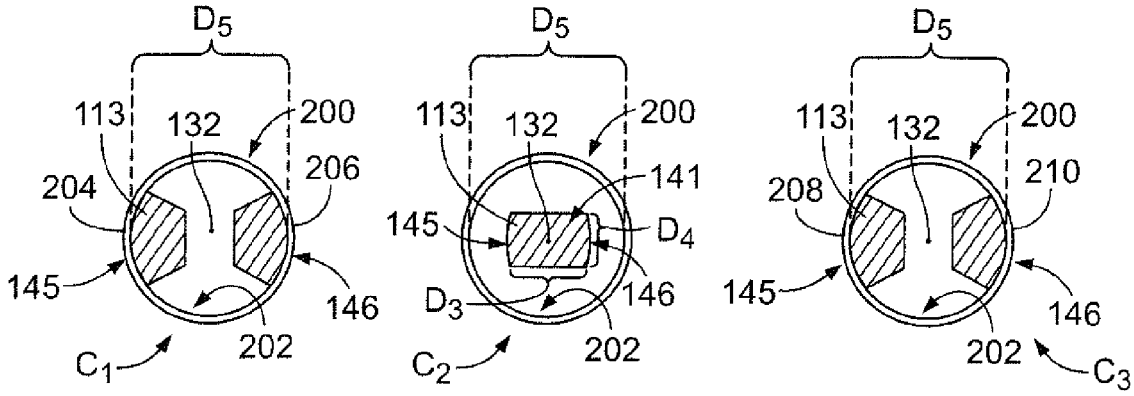
FIG. 4 illustrates cross-sectional views of a plated thru-hole (PTH) having the contact tail therein in which the cross-sectional views are taken at different axial locations.

As shown in FIGS. 2 and 3, the contact body 130 may include a first (or leading) compliant region 136, a second (or trailing) compliant region 138, and a joint region 140 therebetween. The joint region 140 joins the compliant regions 136, 138. The leading end 142, the first and second compliant regions 136, 138, and the joint region 140 are configured to be inserted into one of the PTHs 200 (FIG. 4). The compliant regions 136, 138 are configured to mechanically and electrically engage the PTH 200, although the compliant regions 136, 138 are not required to mechanically engage the PTH 200 simultaneously. Instead, only one of the compliant regions 136, 138 may mechanically engage the PTH 200. Unlike the compliant regions 136, 138, the joint region 140 may be dimensioned to move freely through the PTH 200. For example, the joint region 140 may not be compressed or mechanically deformed radially inward by the PTH 200 during the insertion operation.

The leading end 142, the first and second compliant regions 136, 138, and the joint region 140 have different axial locations along the central axis 132. The compliant region 136 is furthest from the body portion 134, the joint region 140 is the next furthest from the body portion 134, and the compliant region 138 is closest to the body portion 134. In the illustrated embodiment, there are only two compliant regions 136, 138 and one joint region 140. In alternative embodiments, there may be more. For example, there may be first, second, and third compliant regions with a first joint region joining the first and second compliant regions and a second joint region joining the second and third compliant regions.

The contact tail 113 may include a plurality of stamped edges 145-148. With respect to FIG. 3 only, the portion of the contact tail 113 that is insertable into the PTH 200 defines a body plane $P_1$ which is a mid-plane between respective opposite sides 131, 133 of the contact body 130. The body plane $P_1$ intersects the contact body 130 as indicated by the dashed lines along the stamped edges 146-148 in FIG. 3. More specifically, the stamped edges 145-148 intersect the body plane $P_1$. In alternative embodiments, one or more portions of the contact tail 113 may not intersect the body plane $P_1$. Instead, portions may project away from the body plane $P_1$. For example, one or both of the compliant regions 136, 138 may be C-shaped such that portions of the stamped edges of the C-shaped compliant regions do not intersect the body plane $P_1$. Such portions of the stamped edges may be located above or below the body plane $P_1$.

Embodiments set forth herein may include contact tails that have multiple compliant regions that are configured to directly engage and be deformed by the PTH. Adjacent compliant regions may be separated by a joint region that is dimensioned such that the joint region is not deformed by the PTH. To this end, the joint region may be smaller than the compliant regions such that the joint region may pass freely during the insertion operation. For example, in FIGS. 2 and 3, the compliant regions 136, 138 may have maximum cross-sectional dimensions $D_1$, $D_2$, respectively, that are measured transverse (e.g. perpendicular) to the central axis 132 along a radial axis 194. A maximum cross-sectional dimension may represent the greatest measurable distance between two outwardly-facing surfaces (e.g., the stamped edges 145, 146) of the contact body that face away from the central axis. The cross-sectional dimensions $D_1$, $D_2$ are greater than a diameter $D_5$ (shown in FIG. 4) of the PTH 200. As such, the compliant regions 136, 138 engage the PTH 200 and may be deformed radially inward by the PTH 200.

On the other hand, at least a portion of the joint region 140 may have a cross-sectional area 141 (FIG. 4) that is sized such that the portion(s) of the joint region 140 that have the cross-sectional area 141 is/are not compressed or deformed by the PTH 200. For example, the cross-sectional area 141 may include dimensions $D_3$, $D_4$ ($D_4$ is shown in FIG. 4) that are measured transverse to the central axis 132. In an exemplary embodiment, each of the maximum cross-sectional dimensions $D_1$, $D_2$, and the cross-sectional dimensions $D_3$, $D_4$ may be measured along a respective line that extends through the central axis 132.

In some embodiments, any dimension of the cross-sectional area 141, such as the cross-sectional dimensions $D_3$, $D_4$, may be equal to or less than the diameter $D_5$. Accordingly, the joint region 140 may be dimensioned smaller than the compliant regions 136, 138 and the joint region 140 may move freely through the PTH 200. It should be noted, however, that the joint region 140 may inadvertently engage or slidably engage the PTH 200 during the insertion operation. In such cases, the joint region 140 may not be deformed inwardly.

In the illustrated embodiment, the cross-sectional dimensions $D_1$, $D_2$, $D_3$ are different widths of the contact body 130. As shown, each of the cross-sectional dimensions $D_1$, $D_2$, $D_3$ may be measured along the radial axis 194 that extends perpendicular to the central axis 132. In alternative embodiments, the maximum cross-sectional dimensions $D_1$, $D_2$ are not measured along a common axis and, instead, may be measured along different orthogonal axes. For example, the cross-sectional dimension $D_1$ may extend along the radial axis 194 as shown, but the maximum cross-sectional dimension $D_2$ may extend into the page. In certain embodiments, each of the cross-sectional dimensions $D_3$, $D_4$ of the joint region 140 is less than each of the maximum cross-sectional dimensions $D_1$, $D_2$ of the respective compliant regions 136, 138.

The compliant region 136 has a wall-engaging structure 150 that defines a contact void 152, and the compliant region 138 has a wall-engaging structure 154 that defines a contact void 156. In the illustrated embodiment, the contact voids 152, 156 are defined by the stamped edges 147, 148, respectively. The wall-engaging structures 150, 154 may include portions of the stamped edges 145, 146 that are configured to directly engage the PTH 200. The contact voids 152, 156 permit the wall-engaging structures 150, 154 to be compressed radially inward toward the central axis 132. When the wall-engaging structures 150, 154 are compressed radially inward, the contact voids 152, 156 may reduce in size.

The wall-engaging structures 150, 154 in FIGS. 2 and 3 illustrate one configuration that the compliant regions 136, 138 may have. For instance, the compliant region 136 may include flex beams 160, 162. The flex beams 160, 162 extend between and are connected to the joint region 140 and the leading end 142. The compliant region 138 may include flex beams 166, 168. The flex beams 166, 168 extend between and are connected to the joint region 140 and a base region 164 of the contact body 130. The base region 164 is located between the contact void 156 and the body portion 134 (FIG. 2). As shown in FIG. 3, the flex beams 160, 162, 166, 168 and the central axis 132 are located along the body plane $P_1$. In particular embodiments, each of the wall-engaging structures 150, 154 may be characterized as having an EON-type configuration.

In the illustrated embodiment of FIGS. 2 and 3, the flex beams 166, 168 may be bowed away from each other and have the contact void 156 therebetween. For example, as the stamped edge 146 extends away from the base region 164 toward the joint region 140, the stamped edge 146 may first curve away from the central axis 132 until an apex 170 is reached and then curve toward the central axis 132 as the stamped edge 146 extends to the joint region 140. The apex 170 may represent a portion of the stamped edge 146 that directly engages the PTH 200 (FIG. 4). The stamped edge 145 along the compliant region 138 may be shaped similarly to the opposite stamped edge 146. The stamped edges 145, 146 may also be shaped similarly along the compliant region 136. Accordingly, in the illustrated embodiment, each of the stamped edges 136, 138 may have two apexes 170. As the flex beams 160, 162 and the flex beams 166, 168 are inserted into the PTH 200, the corresponding apexes 170 may engage the PTH 200.

In some embodiments, the joint region 140, extends from the contact void 152 of the compliant region 136 to the contact void 156 of the compliant region 138. The cross-sectional dimension $D_3$ of the joint region 140 is defined between the stamped edges 145, 146, and the cross-sectional dimension $D_4$ is defined between the sides 131, 133. In some embodiments, the contact voids 152, 156 are proximate to each other. For example, a separation distance $Y_4$ (shown in FIG. 2) may be measured between the contact voids 152, 156 along the central axis 132. A ratio of the cross-sectional dimension $D_3$ to the separation distance $Y_4$ may be from about 5:1 to about 1:2 or, more particularly, about 4:1 to about 1:1. The cross-sectional dimension $D_3$ may be greater than the distance $Y_4$.

In the illustrated embodiment, the joint region 140 extends without interruption between the stamped edges 145, 146 and between the contact voids 152, 156. In alternative embodiments, the joint region 140 may include one or more interruptions such as openings, cavities, or voids in the joint region 140.

In the illustrated embodiment, the compliant regions 136, 138 (or the wall-engaging structures 150, 154) have similar EON-type configurations. However, in alternative embodiments, the compliant regions 136, 138 may have other configurations. For instance, at least one of the compliant regions 136, 138 may have a configuration that is similar to the ACTION PIN contact (Tyco Electronics) in which the flex beams are not co-planar. By way of example, the flex beam 160 may be shaped to extend above the body plane $P_1$ in FIG. 3, and the flex beam 162 may be shaped to extend below the body plane $P_1$. When these alternative flex beams 160, 162 are deflected, the flex beams 160, 162 may move closer to the body plane $P_1$ and to each other. An embodiment similar to this is shown and described with respect to FIGS. 8-10. Another configuration for the compliant regions 136, 138 may be similar to the C-Press contact (Winchester Electronics) in which a cross-section of at least one of the compliant regions is C-shaped. In both of these examples, the compliant regions or the wall-engaging structures may define a contact void that allows the compliant region to be compressed.

FIG. 4 illustrates cross-sectional views $C_1$, $C_2$, and $C_3$ of the PTH 200 at different depths within the PTH 200 when the contact tail 113 is disposed therein. For example, the cross-section $C_1$ is a cross-section of the compliant region 136 (FIG. 2). The cross-section $C_2$ is a cross-section of the joint region 140 (FIG. 2), and the cross-section $C_3$ is a cross-section of the compliant region 138 (FIG. 2).

As shown, each of the compliant regions 136, 138 has mating surfaces (or outwardly-facing surfaces) that directly engage an interior wall 202 of the PTH 200. More specifically, the compliant region 136 includes mating surfaces 204, 206, and the compliant region 138 includes mating surfaces 208, 210. In the illustrated embodiment, the mating surfaces 204, 208 correspond to portions of the stamped edge 145, and the mating surfaces 206, 210 correspond to portions of the stamped edge 146. However, in alternative embodiments, the mating surfaces that directly engage the interior wall 202 may not correspond to the stamped edges 145, 146. For example, when the compliant regions 136, 138 are C-shaped, the outwardly-facing surfaces may not be part of the stamped edges. In the illustrated embodiment, the mating surfaces 204, 206, 208, and 210 may correspond to the apexes 170 described above with respect to FIGS. 2 and 3.

The stamped edges 145, 146 along the joint region 140, however, may or may not engage the interior wall 202. Accordingly, the compliant regions 136, 138 may directly engage and be compressed by the PTH 200, but the joint region 140 may pass freely through the PTH 200. Each of the compliant regions 136, 138 may form a mating interface with the PTH 200. The mating interfaces may be located at different depths from the body portion 134 (FIG. 2).

The compliant region 136 is configured to engage the PTH 200 prior to the compliant region 138 engaging the PTH 200 or, in some cases, without the compliant region 138 ever engaging the PTH 200. For some embodiments, the compliant region 136 may pass entirely through the PTH 200 when the compliant region 138 is inserted into the PTH 200. In such cases, the compliant region 136 may be deformed by the PTH 200 before the compliant region 136 clears the PTH 200. In other embodiments, each of the compliant regions 136, 138 may simultaneously engage the PTH 200 during operation.

In particular embodiments, the compliant regions 136, 138 are mechanically separated by the joint region 140 such that compression of the compliant region 136 does not cause compression of the compliant region 138. For example, during an insertion operation, the compliant region 136 engages the PTH 200 before the compliant region 138. The compliant region 136 may be deformed such that the structure of the compliant region 136 is compressed radially inward. The joint region 140 may operate as an inert or rigid element that is not compressed when the compliant region 136 is deformed. As such, the compliant region 138 may not partially deform or flex as the compliant region 136 is being deformed.

Figure 6:
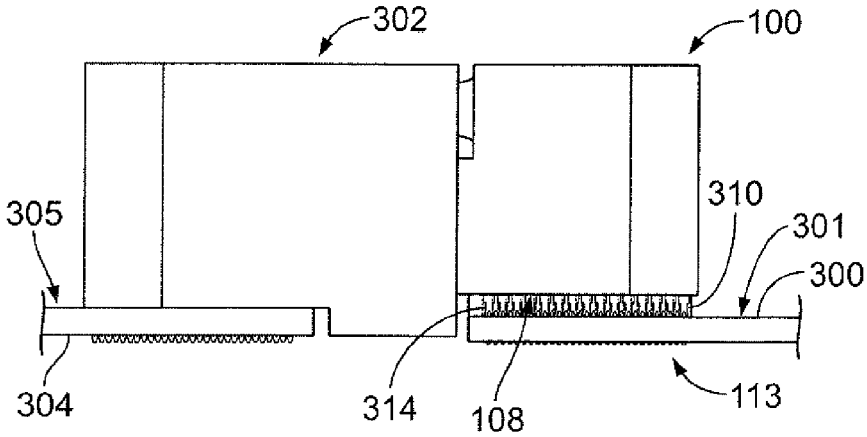
FIG. 6 is a side view of the electrical connector assembly of FIG. 1 mounted to the circuit board having a second spatial position with respect to the electrical connector assembly.

FIG. 5 is a side view of the connector assembly 100 mounted to a circuit board 300 having a first spatial position with respect to the connector assembly 100. FIG. 6 is a side view of the connector assembly 100 mounted to the circuit board 300 in which the circuit board 300 has a second spatial position with respect to the connector assembly 100. In FIGS. 5 and 6, the connector assembly 100 is engaged with a mating connector 302 that is mounted to a circuit board 304. Accordingly, the mating connector 302 and the connector assembly 100 may be used to form communication pathways between the circuit boards 300 and 304.

As described herein, the circuit boards 300 and 304 may, at times, be required to have certain positions with respect to each other. For example, in FIG. 5, the circuit board 300 has a board surface 301 that is located above a board surface 305 of the circuit board 304. In FIG. 6, however, the board surface 301 is located below the board surface 305. These predetermined positions may result in a spatial relationship that is not suitable for a connector assembly having conventional contact tails. For instance, the conventional EON-type contacts may not be able to suitably engage the circuit board 300 at the second spatial position in FIG. 6. The contact tails 113 (FIG. 6), however, are configured to engage the circuit board 300 at each of the first spatial and second spatial positions.

Either of the compliant regions 136, 138 (FIG. 2) may engage the PTHs 200 (FIG. 4) during a common mounting or insertion operation. More specifically, the same operative action (e.g., moving the contact tails 113 into the corresponding PTHs 200) may be configured to locate the compliant regions 136 within the PTHs 200 or the compliant regions 138 within the PTHs. In some cases, an individual may be able to identify through tactile sensation when the compliant regions 136 have engaged the PTHs 200. After inserting the compliant regions 136 into the corresponding PTHs 200, the individual may continue to move (e.g., press) the contact tails 113 into the corresponding PTHs. The joint regions 140 (FIG. 2) may pass freely into the PTHs 200. After the joint regions 140 have passed into the PTHs 200, the compliant regions 138 may then engage the PTHs 200. Again, the individual may be able to identify when the compliant regions 138 have engaged the PTHs 200 through tactile sensation (e.g., increased resistance to insertion).

In some embodiments, the connector assembly 100 may include a discrete layer that is configured to surround or cover exposed portions of the contact tails 113. For example, in FIG. 5, a discrete layer 308 may function as a cap or cover that receives the compliant regions 136 (FIG. 2). In FIG. 6, a discrete layer 310 may be an intermediate component that covers the compliant regions 138 (FIG. 2). The discrete layers 308, 310 may include passages 312, 314, respectively, that receive the corresponding contact tails 113. The contact tails 113 and the passages 312, 314 are shown in phantom in FIGS. 5 and 6.

However, it is noted that the discrete layers 308, 310 are not required. For example, in some embodiments, after being mounted to the circuit board 300, exposed portions of the contact tails 113 that extend completely through the circuit board 300 may be removed using a tool.

Figure 7:
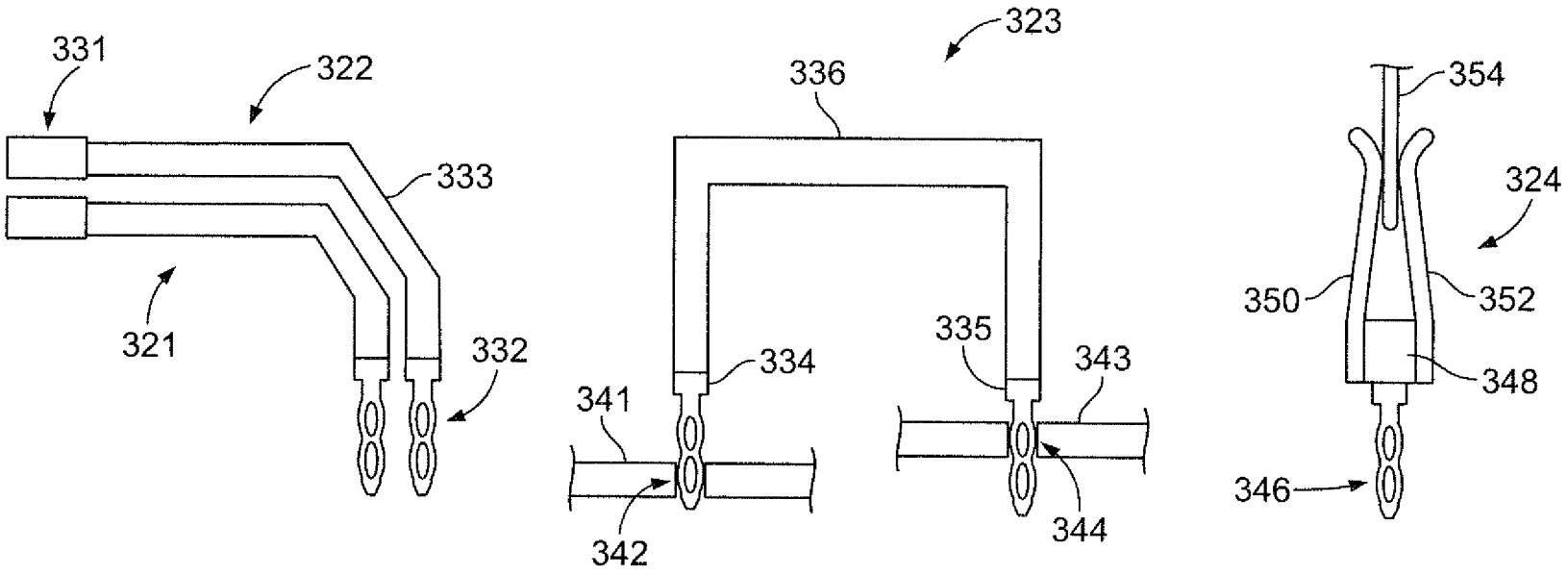
FIG. 7 illustrates various types of electrical contacts that may be used with the contact tail formed in accordance with one embodiment.

FIG. 7 illustrates exemplary electrical contacts 321-324 that are formed in accordance with various embodiments. The electrical contacts 321-324 may include multi-compliant contact tails similar to the contact tail 113 described herein. In the first example, the electrical contacts 321, 322 may be part of a common lead frame. Each of the electrical contacts 321, 322 includes a receptacle end 331, a contact tail 332, and a body portion 333 therebetween. The body portions 333 are substantially longer than the corresponding contact tails 332. The receptacle end 331 may be shaped as a socket contact that receives a corresponding pin contact. The electrical contacts 321, 322 may be used with the connector assembly 100 (FIG. 1). For instance, the body portion 134 (FIG. 2) may be part of one of the body portions 333.

The electrical contact 323 is a bridge contact that is configured to be part of a bridge connector (not shown). The bridge connector may join a plurality of circuit boards substantially edge-to-edge. To this end, the electrical contact 323 may include contact tails 334, 335 and a body portion 336 extending therebetween. The body portion 336 is substantially longer than the contact tails 334, 335. In some embodiments, a first circuit board 341 may have a PTH 342 that receives the contact tail 334, and a second circuit board 343 may have a PTH 344 that receives the contact tail 335. If the first and second circuit boards are not co-planar, but are vertically offset with respect to each other as shown in FIG. 7, the contact tails 334, 335 may engage the circuit boards 341, 343, respectively, with different compliant regions.

The electrical contact 324 is configured to receive an elongated electrical conductor, such as an elongated pin contact 354. To this end, the electrical contact 324 may include a body portion 348 and a pair of arms 350, 352 projecting therefrom. The electrical contact also includes a contact tail 346 that projects in a direction that is opposite the arms 350, 352. The arms 350, 352 are configured to receive and engage the pin contact 354. For example, the arms 350, 352 may engage the pin contact 354 and be deflected away from each other. In some embodiments, the body portion 348 and the arms 350, 352 are configured to be located within a connector housing (not shown). The contact tail 346 may project away from the connector housing and be configured for insertion into a PTH (not shown).

It is noted that the electrical contacts 321-324 merely provide examples of the different types of electrical contacts that the contact tails described herein may be used with. It is understood that a variety of other types of electrical contacts exist and may be used with the multi-compliant contact tails.

Figure 8:
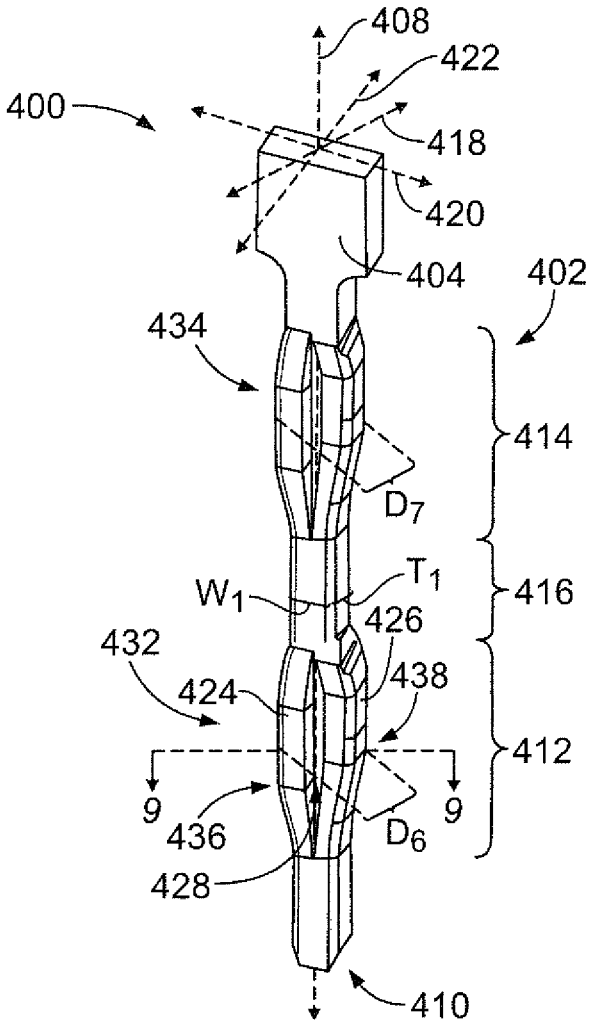
FIG. 8 is a perspective view of a contact tail of an electrical contact formed in accordance with one embodiment.
Figure 9:
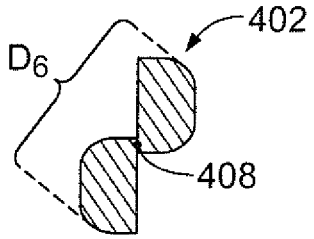
FIG. 9 is a cross-sectional view of the contact tail of FIG. 8 taken along the line 9-9 in FIG. 8.
Figure 10:
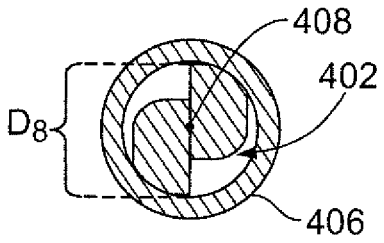
FIG. 10 is a cross-sectional view of the contact tail of FIG. 8 after a compliant region of the contact tail has been inserted into a PTH.

FIGS. 8-10 illustrate different views of a portion of an electrical contact 400 (FIG. 8) that has a compliant contact tail 402. By way of example only, the electrical contact 400 may be similar to the electrical contacts 321-324 (FIG. 7), except for the contact tail. As shown in FIG. 8, the electrical contact 400 includes the contact tail 402 and a body portion 404. The contact tail 402 is coupled to the body portion 404 and is configured to be inserted into a PTH, such as the PTH 406 (shown in FIG. 10). The contact tail 402 extends from the body portion 404 along a central axis 408 to a leading end 410. The contact tail 402 includes first and second compliant regions 412, 414 that are located between the leading end 410 and the body portion 404. The contact tail 402 also has a joint region 416 that joins the compliant regions 412, 414. Each of the compliant regions 412, 414 is dimensioned to mechanically engage the PTH 406 when inserted therein. The joint region 416 may be dimensioned smaller than the first and second compliant regions 412, 414. In particular embodiments, the joint region 416 may be dimensioned such that the joint region 416 moves freely through the PTH 406.

For example, the compliant regions 412, 414 may have maximum cross-sectional dimensions $D_6$, $D_7$, respectively, that are measured transverse (e.g. perpendicular) to the central axis 408 along a radial axis 418. The joint region 416 may have width $W_1$ and a thickness $T_1$, which are measured along radial axes 420, 422, which are perpendicular to each other. As shown, the radial axes 418, 420, 422 are different axes that are orthogonal with respect to the central axis 408. However, in other embodiments, the thickness $T_1$ and the cross-sectional dimensions $D_6$, $D_7$ may be measured along the radial axis 422. In an exemplary embodiment, each of the cross-sectional dimensions $D_6$, $D_7$, the thickness $T_1$, and the width $W_1$ are measured along a line that extends through the central axis 408.

At least one of the compliant regions 412, 414 may include a plurality of flex beams that are connected to the joint region 416. For example, in the illustrated embodiment, the compliant region 412 includes flex beams 424, 426 that extend between the joint region 416 and the leading end 410. In some cases, the flex beams 424, 426 may have a contact void 428 therebetween. The central axis 408 may extend through the contact void 428. However, the flex beams 424, 426 are not required to have a contact void 428 therebetween. During the manufacturing of the electrical contact 400, sheet material may be stamped to provide outer stamped edges 436, 438. The material where the compliant regions 412, 414 are formed may be sheared (e.g., split) to form the flex beams 424, 426. The shearing may completely separate the flex beams 424, 426 along the region where the contact void 428 will be formed or, in some cases, a thin intermediate material may still join the flex beams 424, 426. During or after the shearing, the flex beams 424, 426 may be bent (e.g., deformed) so that the flex beams 424, 426 are bowed in opposite directions as shown in FIG. 8. After manufacture of the electrical contact 400, the contact void 428 may or may not exist. In some cases, the intermediate material may still extend between and join the flex beams 424, 426.

Like the contact tail 113 (FIG. 1), the compliant regions 412, 414 may have wall-engaging structures 432, 434. The wall-engaging structures 432, 434 may include portions of the stamped edges 436, 438 that are configured to directly engage the PTH 406. The configurations of the compliant regions 412, 414 may permit the wall-engaging structures 432, 434 to be compressed radially inward toward the central axis 408. For example, FIGS. 9 and 10 are cross-sectional views of the contact tail 402 before and after, respectively, being inserted into the PTH 406. As shown in the cross-sectional views, a material distribution of the contact tail 402 is compressed or concentrated radially inwardly toward the central axis 408 after engaging the PTH 406. More specifically, the dimensions $D_6$, $D_7$ (FIG. 8) are reduced to be equivalent to a diameter $D_8$ of the PTH 406.

In another embodiment, a circuit board assembly is provided that includes a circuit board having a plurality of PTHs and an electrical connector assembly that is mounted to the circuit board. The connector assembly includes a connector housing having a mating face configured to engage a mating connector and a mounting face coupled to the circuit board. The connector assembly also includes a plurality of electrical contacts having contact tails that project from the mounting surface. The contact tails extend along respective central axes to respective leading ends. Each of the contact tails of the plurality of electrical contacts is configured to be inserted into a corresponding PTH. Each of the contact tails of the plurality of electrical contacts includes first and second compliant regions that are located between the leading end and the mounting surface. Each of the contact tails of the plurality of electrical contacts includes a joint region that joins the first and second compliant regions. Each of the first and second compliant regions is dimensioned to mechanically engage the PTH when inserted therein. The joint region is dimensioned smaller than the first and second compliant regions such that the joint region moves freely through the PTH.

Optionally, the circuit board assembly may include a discrete layer that covers or surrounds exposed portions of the contact tails. The discrete layer may be located between the connector assembly and the circuit board, or the circuit board may be located between the discrete layer and the connector assembly.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a connector housing having a mating face configured to engage a mating connector and a mounting face configured to be mounted onto a circuit board having a plurality of plated thru-holes (PTHs);

a plurality of electrical contacts having contact tails that project from the mounting surface, the contact tails extending along respective central axes to respective leading ends, each of the contact tails of the plurality of electrical contacts being configured to be inserted into a corresponding PTH and comprising:

first and second compliant regions that are located between the leading end and the mounting surface; and a joint region that joins the first and second compliant regions;

wherein each of the first and second compliant regions is dimensioned to mechanically engage the PTH when inserted therein and establish an electrical connection with the PTH, the joint region being dimensioned smaller than the first and second compliant regions such that the joint region moves freely through the PTH; and a discrete layer extending parallel to the mounting face of the connector housing and having passages that receive corresponding contact tails, the discrete layer covering the first compliant regions while the second compliant regions are mechanically engaged to the corresponding PTHs or covering the second compliant regions while the first compliant regions are mechanically engaged to the corresponding PTHs.

2. The connector assembly of claim 1, wherein at least one of the first and second compliant regions includes a plurality of flex beams that are connected to the joint region, the flex beams being bowed away from the central axis, wherein the flex beams engage the corresponding PTH and are deflected toward the central axis when the contact tail is inserted into the corresponding PTH.

3. The connector assembly of claim 1, wherein each of the first and second compliant regions includes a wall-engaging structure that defines a contact void, the contact void permitting the wall-engaging structure to be compressed radially inward and thereby reduce a size of the contact void.

4. The connector assembly of claim 1, wherein the joint region is defined between two stamped edges and has a maximum cross-sectional dimension that is transverse to the central axis extending between the two stamped edges, the joint region extending without interruption between the stamped edges.

5. The connector assembly of claim 1, wherein the contact tails are configured such that a common insertion operation, in which the contact tails move in a single direction into the corresponding PTHs, is capable of positioning at least one of the first and second compliant regions of each contact tail within the corresponding PTH.

6. A circuit board assembly comprising:

a circuit board having a plurality of plated thru-holes (PTHs); and an electrical connector assembly comprising a connector housing having a mounting face mounted onto the circuit board, the connector assembly including a plurality of electrical contacts having contact tails that project from the mounting surface, the contact tails extending along respective central axes to respective leading ends, each of the contact tails of the plurality of electrical contacts being inserted into a corresponding PTH of the circuit board, each of the contact tails including first and second compliant regions and a joint region that joins the first and second compliant regions;

wherein each of the first and second compliant regions is dimensioned to mechanically engage the corresponding PTH when inserted therein and establish an electrical connection with the PTH, the joint region being dimensioned smaller than the first and second compliant regions such that the joint region is permitted to move freely through the PTH;

wherein the corresponding PTHs either engage the first compliant regions of the electrical contacts while the second compliant regions are unengaged with the corresponding PTHs or engage the second compliant regions while the first compliant regions are unengaged with the corresponding PTHs.

7. The circuit board assembly of claim 6, further comprising a discrete layer extending parallel to the circuit board and having passages that receive corresponding contact tails, the discrete layer covering the first compliant regions while the second compliant regions are engaged to the corresponding PTHs or covering the second compliant regions while the first compliant regions are engaged to the corresponding PTHs.

8. The circuit board assembly of claim 6, wherein each of the first and second compliant regions of the plurality of electrical contacts includes a contact void, the joint region extending from the contact void of the first compliant region to the contact void of the second compliant region, wherein the joint region has a maximum cross-sectional dimension that is transverse to the central axis, the maximum cross-sectional dimension being greater than a distance between the contact voids along the central axis.

* * * * *